United States Patent [19]

Jackson

[11] Patent Number: 4,641,446

[45] Date of Patent: Feb. 10, 1987

[54] APPARATUS AND METHOD FOR PRODUCING A MULTISIDED, MULTICOLORED DISPLAY

[76] Inventor: Thomas L. Jackson, 2222 Cass St., Fort Wayne, Ind. 46808

[21] Appl. No.: 710,329

[22] Filed: Mar. 11, 1985

[51] Int. Cl.[4] ..... G09F 13/00

[52] U.S. Cl. ..... 40/444; 40/581

[58] Field of Search ..... 40/564, 431, 444, 581; 362/67, 27

[56] References Cited

U.S. PATENT DOCUMENTS

| | | | |
|---|---|---|---|
| 1,747,556 | 2/1930 | Price | 40/431 |
| 1,847,647 | 3/1932 | Gooley | 240/10 R |
| 1,880,026 | 9/1932 | Singerman | 240/10 R |
| 1,880,230 | 10/1932 | Beck | 240/10 R |
| 2,279,241 | 4/1942 | Musaphia | 88/16 |
| 2,421,116 | 5/1947 | Clark | 200/81.9 |
| 2,791,998 | 5/1957 | Decker | 40/431 |
| 2,801,484 | 8/1957 | Pabst | 40/431 |
| 3,062,085 | 11/1962 | Smith | 84/464 |
| 3,242,330 | 3/1966 | Schoffer | 240/10.1 |
| 3,366,786 | 1/1968 | Delano | 240/31 |
| 3,683,526 | 8/1972 | Horvath | 40/431 |
| 3,701,897 | 10/1972 | Pennington et al. | 40/431 |

*Primary Examiner*—Robert Peshock
*Assistant Examiner*—Wenceslao J. Contreras
*Attorney, Agent, or Firm*—Lundy and Walker

[57] ABSTRACT

An apparatus and method for producing a multisided, multicolored display which includes an enclosure with a plurality of translucent light scattering sides, top and bottom. A plurality of light sources are positioned in a spaced apart relationship to radiate sufficiently to illuminate all of the light scattering sides. Each of the light sources is of a different color, and the radiation from each source overlaps radiation from the other sources on the light scattering sides. A plurality of symbols may be interposed between the light sources and the light scattering sides to create colored images. Each of the enclosures represents a module, wherein several discrete modules are structured in a matrix fashion, and the entire matrix comprises the display.

7 Claims, 9 Drawing Figures

APPARATUS AND METHOD FOR PRODUCING A MULTISIDED, MULTICOLORED DISPLAY

BACKGROUND OF THE INVENTION

The subject matter of the invention relates to a visual display, and more particularly to a multisided, multicolored display wherein all the visual images on each side are created from common light sources.

In the sign and display industry, most of today's signs are either one or two sided, and the outer surface depicts printing or symbols in a conventional manner. If lighting is involved, white light internally illuminates the sign. Such signs and displays do not have a variety of colors generated internally, as well as having four sides showing a depiction based upon the internal positioning of symbols.

Similarly, conventional signs and displays are not based upon a modular matrix structure which can be easily adapted to depict a sign or display of any given dimension, wherein each module is a discrete component of the sign or display and the matrix itself represents the visual depiction.

Conventional signs and displays are not subject to efficient, rapid alterations, wherein if it is desired that a sign be changed, a new sign or display must be ordered. Likewise, conventional signs and displays do not exist which create multisided, multicolored visual images presenting a rainbow effect that is eye-catching, as well as presenting artistic renditions of unique display features.

Finally, conventional signs are relatively expensive when any unique feature is desired.

The multisided, mutlicolored display of the invention has numerous applications. The display can be used in toys and games, in furniture as table tops, and in ornamental sides and partitions. Interior or exterior walls can utilize the display for decorative or advertising purposes. By selecting the particular display, the display is applicable to amusement park fun houses and alike and also for therapeutic treatment of stress and alike. The display can be used as works of art or as decorative appliances such as clocks, radio and television sets, and alike.

It is therefore highly desirable to provide a new and improved apparatus and method for producing a multisided, multicolored display.

It is also highly desirable to provide an improved apparatus and method for producing a multisided, multicolored display which is easily adaptable to any geometric dimension desired.

It is also highly desirable to provide an improved apparatus and method for producing a multisided, multicolored display which is composed of discrete modular units arranged in matrix form, which presents a unique visual display.

It is also highly desirable to provide an improved apparatus and method for producing a multisided, multicolored display which presents eye-catching, unique artistic renditions.

It is also highly desirable to provide an improved apparatus and method for producing a multisided, multicolored display which is cost effective and efficient as well as being easy to modify, alter or rearrange the visual depiction.

It is also highly desirable to provide an improved apparatus and method for producing a multisided, multicolored display wherein the hue, saturation, and brightness of the light sources therein are easily altered.

It is also highly desirable to provide an improved apparatus and method for producing a multisided, multicolored display which is easily adaptable to provide animated symbols, to depict objects in motion, and to depict three dimensional effects.

SUMMARY OF THE INVENTION

It is therfore an object to provide a new and improved apparatus and method for producing a multisided, multicolored display.

It is also an object of this invention to provide an improved apparatus and method for producing a multisided, multicolored display which is easily adaptable to any geometric dimension desired.

It is also an object of this invention to provide an improved apparatus and method for producing a multisided, multicolored display which is composed of discrete modular units arranged in matrix form which produces a unique visual display.

It is also an object of this invention to provide an improved apparatus and method for producing a multisided, multicolored display which presents eye-catching, unique artistic renditions.

It is also an object of this invention to provide an improved apparatus and method for producing a multisided, multicolored display which is cost effective and efficient as well as being easy to modify, alter or rearrange the visual depiction.

It is also highly desirable to provide an improved apparatus and method for producing a multisided, multicolored display wherein the hue, saturation and brightness of the light sources therein are easily altered.

It is also an object of this invention to provide an improved apparatus and method for producing a multisided, multicolored display which is easily adaptable to provide animated symbols, to depict objects in motion, and to depict three dimensional effects.

Finally, it is also an object of this invention to provide an improved apparatus and method for producing a multisided, multicolored display which has all of the above-identified features.

Briefly what is provided is an apparatus and method for producing a multisided, multicolored display which includes an enclosure with a plurality of translucent light scattering sides, top and bottom. A plurality of light sources are positioned in a spaced apart relationship to radiate sufficiently to eliminate all of the light scattering sides. Each of the light sources is of a different color, and the radiation from each source overlaps radiation from the other sources of the light scattering sides. A plurality of symbols may be interposed between the light sources and the light scattering sides to create colored images. Each of the enclosures represents a module, wherein several discrete modules are structured in a matrix fashion and the entire matrix comprises the display.

BRIEF DESCRIPTION OF THE DRAWINGS

The above-mentioned and other features and objects of this invention and the manner of attaining them will become more apparent and the invention itself will be best understood by reference to the following description of an embodiment of the invention taken into conjunction with the accompanying drawings, wherein.

DESCRIPTION OF A SPECIFIC EMBODIMENT

Figure 1:
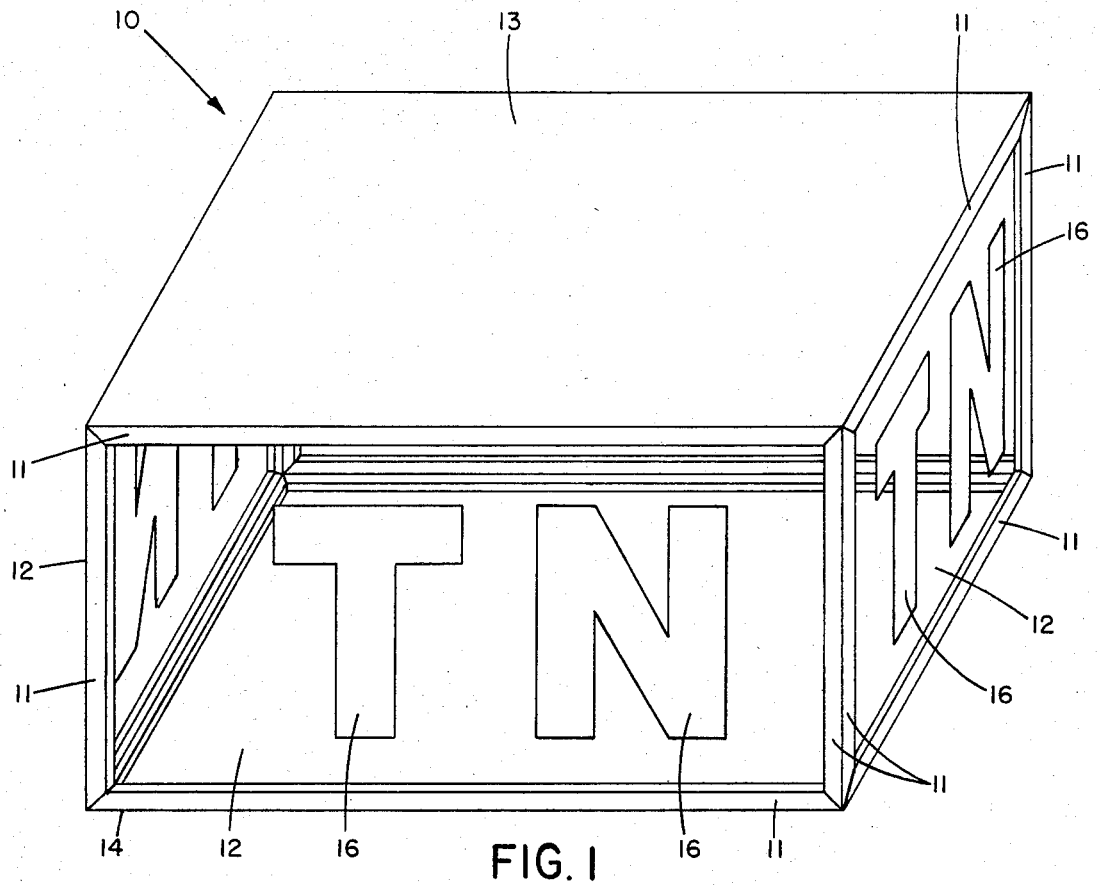
FIG. 1 is a perspective view of the multisided, multicolored display of the invention which illustrates a modular unit.

Referring now to FIG. 1, the apparatus and method for producing a multisided, multicolored display 10 is illustrated. The external display is planar and composed of a plurality of translucent light scattering sides 12 and an opaque top 13 and bottom 14. In a specific embodiment, the sides 12, top 13 and bottom 14 could have a reflective surface facing inside to enhance scattering of light, as desired. The enclosure of display 10 is constructed using conventional building techniques, i.e., framing the corners with wood ribs 11 and fastening the various sides, top and bottom using sealants or adhesives, as well as more conventional fastening methods involving screws, nails, or staples. The particular construction selected is not critical to the apparatus disclosed, and any of several methods could be utilized as is readily apparent to one skilled in the art.

Symbols 16 are internally mounted on the translucent sides 12 of enclosure 10. Any one of numerous mounting techniques can be utilized as would be readily apparent to one skilled in the art. These would include glue, tape, pins as well as more conventional methods utilizing various fasteners. Symbols 16 can be also suspended from ribs 11 or sides 12 by transparent elements or thin opaque elements neither of which would affect the appearance of the display. Symbols 16 can be of any shape or size, and can be mounted on or at various distances from the sides 12.

Figure 2:
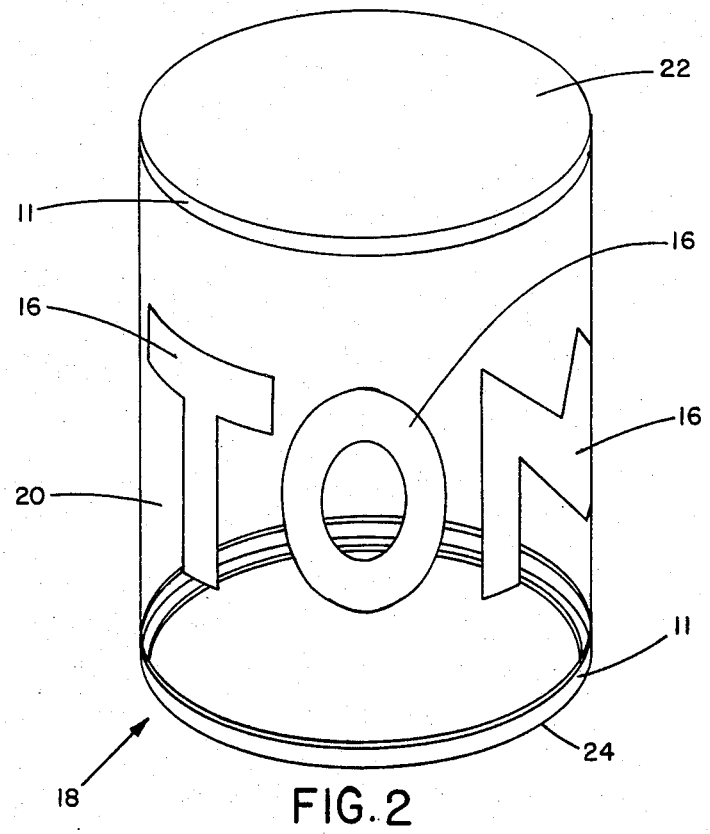
FIG. 2 is a perspective view of an alternative embodiment of the invention.

Referring now to FIG. 2, an alternative embodiment 18 is illustrated. In this particular embodiment the display is cylindrical in shape and consists of a cylindrical translucent light scattering side 20 and an opaque top 22 and bottom 24. In this embodiment the symbols 16 are mounted in a similar fashion internally on side 20.

In other specific embodiments, the sides 12 and 20, top 13 and bottom 14 can be of a variety of light scattering constructions including frosted glass or smoke glass, plastic sheets which have a "milky" appearance, thin panels having two spaced apart sheets of glass or plastic material with the peripheral boundaries thereof sealed, similar to a sealed window pane, with either colored water or milky water or smoke-like vapor contained therein.

Referring now to FIGS. 3, 4, 5 and 6, the internal structure of display 10 is illustrated.

Figure 3:
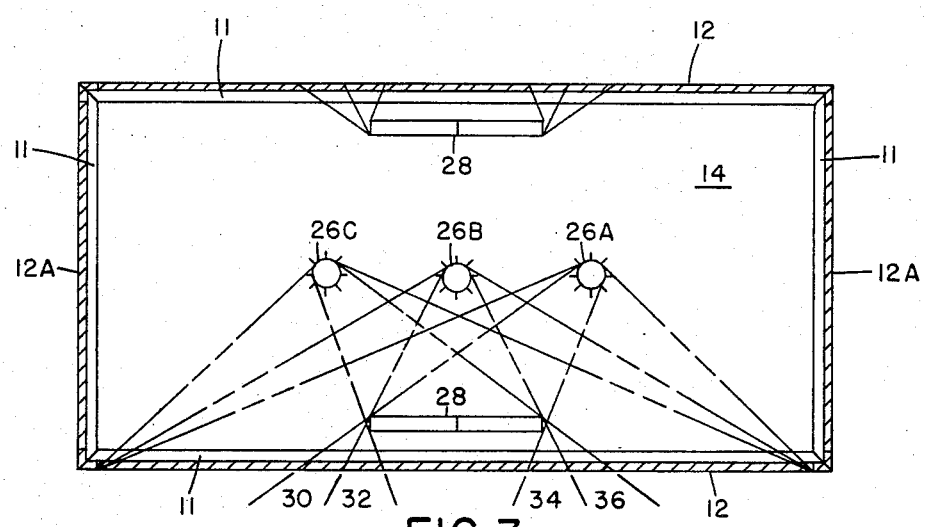
FIG. 3 is a top view of the embodiment of the invention shown in FIG. 1.

FIG. 3 depicts a two-sided display utilizing two spaced apart translucent light scattering sides 12, light sources 26(*a*), 26(*b*) and 26(*c*) mounted there between and symbols 28 mounted on or adjacent to sides 12 in the same manner as symbols 16. In a specific embodiment, light sources 26 each emit different colored light, resulting in translucent screens 12 being illuminated with the mixture of light from the various light sources.

By varying the position of symbols 28 with reference to the light sources 26, various multicolored visual effects can be created. In the embodiment illustrated, four separate color regions 30, 32, 34 and 36 are created due to the various positioning of the light sources 26. Color region 30 is created as a result of radiation from light source 26(*a*) being truncated by symbol 28. Thus, color region 30 represents a combination of the mixture of light from sources 26(*b*) and 26(*c*). Similarly, because of the positioning of symbol 28, color region 32 is created by the radiation from light source 26(*c*), as both light sources 26(*a*) and 26(*b*) are truncated. A similar phenomenon creates color regions 34 and 36.

By varying the positions of light sources 26(*a*), 26(*b*) and 26(*c*), as well as symbols 28, a multicolored rainbow effect is created on translucent sides 12.

Figure 4:
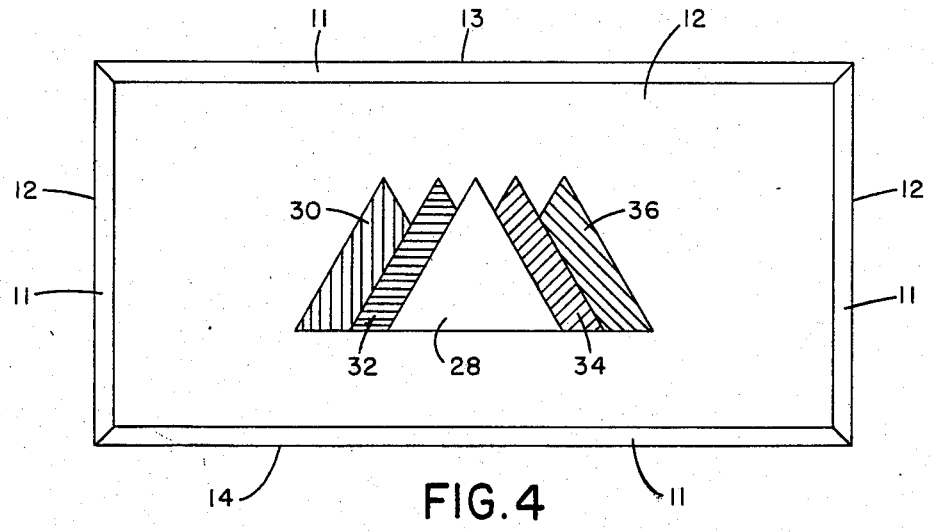
FIG. 4 is a front plan view of the embodiment shown in FIG. 1 illustrating the multicolored phenomenon created by the invention.

Referring now to FIG. 4, the visual image apparent to an observer viewing illuminated sides 12 is depicted. Symbol 28 is shown in the center of screen 12 as are the various color regions 30, 32, 34 and 36. Each of these regions represents a unique color area, and the remainder of the screen is a mixture of all three light sources. In a specific embodiment, the three light sources are complementary primary colors which illuminate the remaining area of translucent sides 12 outside of the four color regions enumerated above with white light. It can readily be seen by one skilled in the art that by varying the hues of the color sources, any of a number of dramatic multicolored effects can be created, and the various eye-catching, artistic renditions which can be created are innumerable.

Note that further unique visual effects can be created by varying the light transmitting properties of the material used in symbols 28 along a continuum which includes variations from transparent to translucent to partially translucent to opaque. By varying the color of the symbol 28, and the color of the translucent sides 12, an innumerable number of multicolored effects can be created.

Figure 5:
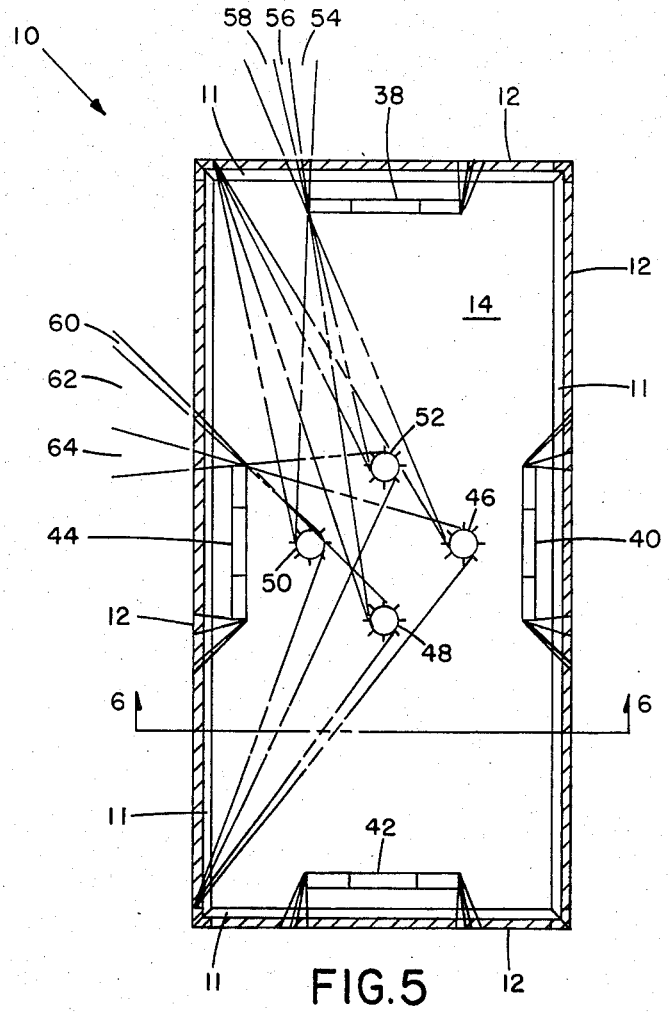
FIG. 5 is a top plan view of an embodiment of the invention which utilizes four sides in its display.

Referring now to FIG. 5, an alternative embodiment of display 10 is disclosed. This embodiment illustrates a four-sided display, all sides being illuminated from common light sources.

Symbols 38, 40, 42 and 44 as corresponding to each of the four sides of this embodiment in the same manner as symbols 16 and 28 above described. These symbols are merely representative of the many depictions which can be illustrated on the four sides of any a given display, and are shown as one symbol per side merely for illustrative purposes. Thus, any particular symbol, logo, caricature, phrase, or sentence could be shown on each particular side 12.

Figure 7:
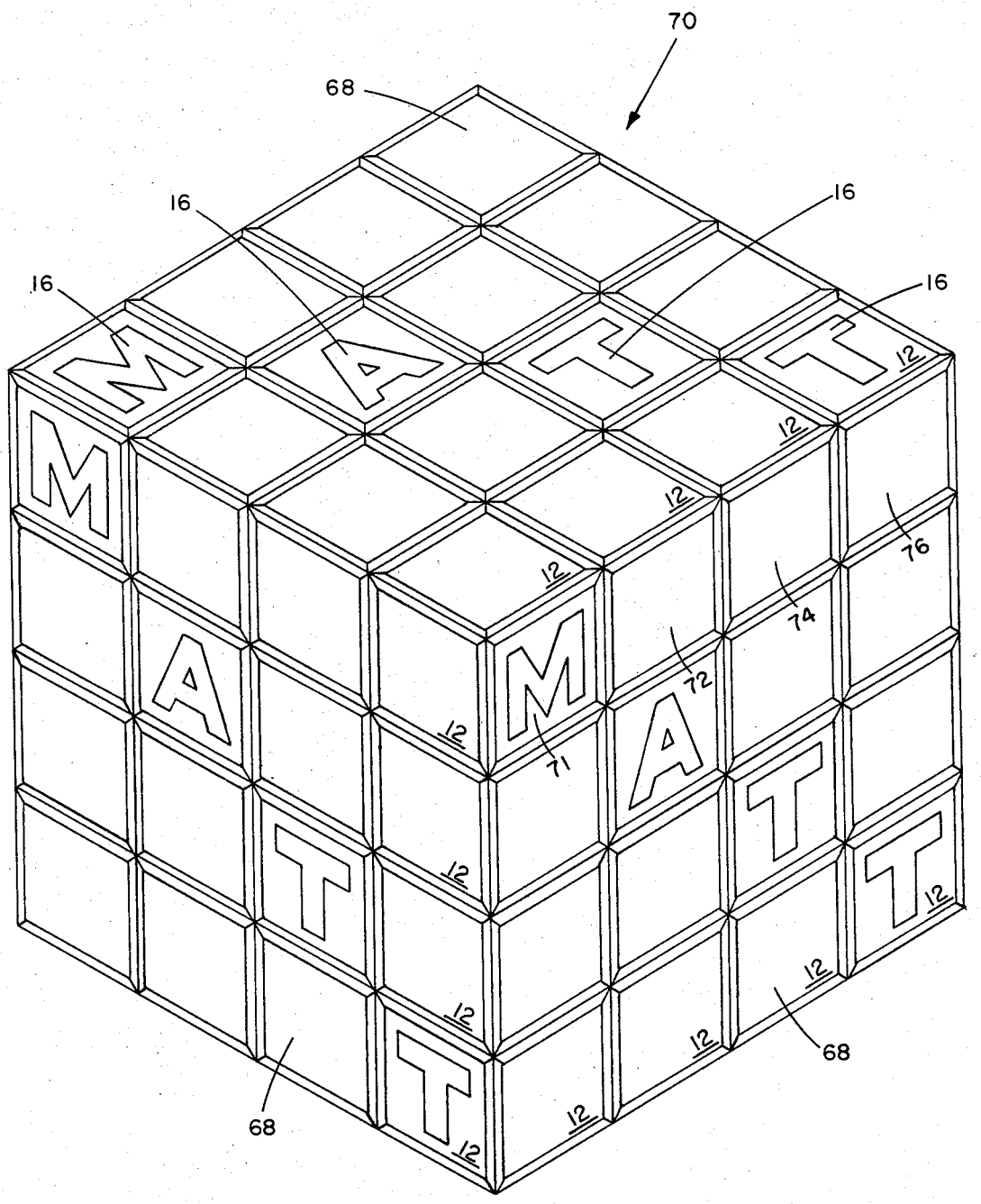
FIG. 7 is a perspective view of an embodiment of the invention which illustrates a sign composed 4×4×4 matrix array.
Figure 8:
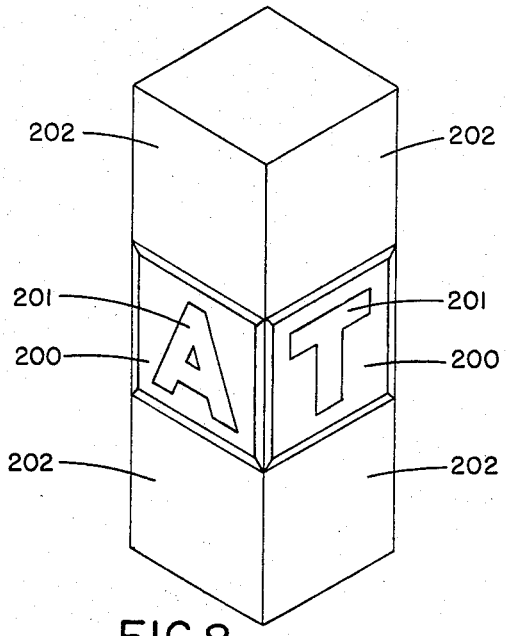
FIG. 8 is a perspective view of an alternative embodiment of the invention illustrating a display indirectly illuminated.

Light sources 46, 48, 50 and 52 are shown arranged in a particular diamond shape located in the center of display 10. The specific arrangement used in any embodiment is a function of the geometry of sides 12, and the intensity of the light sources 46, 48, 50 and 52. If sides 12 partially define a cube, as shown in FIGS. 7, 8 and 9, for example, then if white light illumination of sides 12 is desired, light sources 46, 48 50 and 52 will each have the same intensity and will be configured in a square shape with each essentially equal distance from a side 12 so as to approximate a point light source.

Since each of the light sources radiate 360°, each side 12 is illuminated with a mixture of the four light sources, with the exception of the rainbow phenomenon created at the periphery of each of the symbols 38, 40, 42 and 44. Thus, if complementary colors are selected, the majority of the sign display would be white light, with the light around the periphery of each of the symbols being of a rainbow effect as described above.

In regard to symbol 38, unique color regions 54, 56 and 58 would be created around its periphery. These color regions are created in a similar manner as that disclosed above in regard to FIG. 1, wherein color region 58 would include a mixture of light from sources 52, 50, 48 as light source 46 is effectively blocked from region 58. Similarly, color region 56 would include a mixture of light from sources 48 and 50 with an absence of light from sources 52 and 46. And finally, light region 54 would simply include light from source 50, as light from sources 46, 48 and 52 are each masked therefrom.

A similar phenomenon would create unique hue regions 60, 62 and 64 around the periphery of symbol 44. The same phenomenon would occur in regard to symbols 40 and 42 in FIG. 5.

It can readily be seen by one skilled in the art that by varying the geometric shapes and placements and intensity of the light sources 46, 48, 50 and 52 in the center of display 10, any given number of unique color variations can be created in the display. For example, by adding an additional six light sources and placing them in a circle rather than the above-mentioned diamond shape, a unique color scheme would be created. By adding several light sources and placing them in a square configuration, another unique display would be created. Alternatively, three parallel rows and columns of three sources would create still different light regions on each side of a symbol 38, 40, 42 or 44 from those created four or more light sources in the above circle and square configurations. Further, by varying the translucency of each of the symbols 38, 40, 42 and 44 as well as varying the color and intensity of the light sources 46, 48, 50 and 52 and their positions, any number unique artistic renditions can be created.

Figure 6:
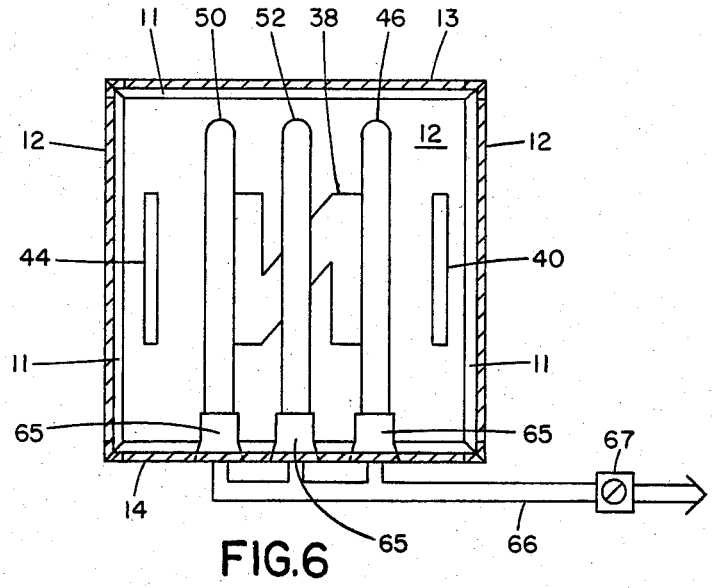
FIG. 6 is a cross-sectional view of the embodiment of the invention illustrated in FIG. 5, taken substantially along line 6—6 of FIG. 5.

Referring now to FIG. 6, symbols 38, 40 and 44 are illustrated, as well as light sources 50, 52 and 46. Light source 48 is hidden from view. Symbol 38 is shown as the letter N simply for illustrative purposes. Light sources 52, 50, 48 and 46 are shown as tubular incandescent bulbs mounted in bases 65 of display 10. Power 66 can be supplied to the bases 65 using any conventional method of electrical connection as desired. In a specific embodiment, rheostats 67 are placed in series with sources 46, 48, 50 and 52 so that the intensity of each can be adjusted, as desired.

In this particular embodiment, the light sources are shown as mounted in the bottom 14 of display 10; however, in alternative embodiments, unique features can be created by mounting the light sources at the center of display 10 or mounting them to the top 13 of the display 10. Alternatively, a portion of the light sources could be mounted to the top 13 and the remainder of the light sources could be mounted to the bottom 14 thereby creating alternative unique features.

The visual images created by display 10 are a result of number and kind of symbols 38, 40 and 44 and the hue, saturation, and intensity of the light sources 46, 48, 50 and 52. In a given embodiment, the light sources can be merely colored bulbs; however, alternatively, plastic filters can be used to alter the color of each source wherein the source could be merely white light bulbs. Thus, one could control both the hue and saturation of a given color. Finally, the intensity of each light source is a function of the wattage selected. As can be seen by one skilled in the art a myriad of unique visual displays can be created using these principles.

While incandescent electric light bulbs are illustrated in the drawings as light sources 26, all known light sources have application in this invention, and the display of the invention can be varied by making use of the different properties of a variety of light sources. Direct and reflective light sources, fluorescent and incandescent light sources neon tubes, and open flame light sources all have their unique characteristics and applicability with regard to the display of the invention.

Referring now to FIG. 7 the modular concepts involved in this invention are illustrated. In FIG. 7 the entire display 10 is illustrated as a four column by four row by four deep modular concept. Thus, the matrix is created by individual modules 68, each of which is a discrete component of the entire matrix. Each discrete module is a unit complete in itself as disclosed in FIGS. 1 through 6 referred to above. However, only selected sides of each module 68 need be concerned with in any given matrix array as on some modules three sides are utilized for visual features and on some modules obviously only two sides or one side would be utilized for visual features as shown in matrix 70. In these latter modules, all of the internal rib 11 and wall 12 structure need not be constructed in a specific embodiment, and only sufficient internal structure necessary to isolate and support the individual light sources associated with each module is required.

As will be readily apparent to one skilled in the art, since each module is unique to itself, any given number of color schemes can be created on matrix 70. For example, modules 71, 72, 74 and 76 could each represent unique color schemes around the various symbols by, for example, module 71 being one primary color and each of the module sides 72 through 76 being represented by an alternative primary or secondary color, thereby creating eye-catching, dazzling displays. By utilizing this technique on the entire matrix, a fabulous display can be created. Similarly, with the ease of altering each individual module as disclosed above, any modification can be easily completed.

FIG. 8 is a perspective view of an embodiment of the invention illuminated by indirect light. In FIG. 8, a module is shown in which the light scattering sides are illuminated indirectly, in contrast to the direct illumination of the translucent light scattering sides 12, top 13 and bottom 14 shown in FIGS. 1 through 6. In the specific embodiment illustrated in FIG. 8, the light sources are located behind opaque panels 202 in the opposite ends of a module so as to indirectly illuminate symbol 201 and translucent light scattering sides 200. Such illumination and placement of the light sources creates still further unique multisided, multicolored displays.

Figure 9:
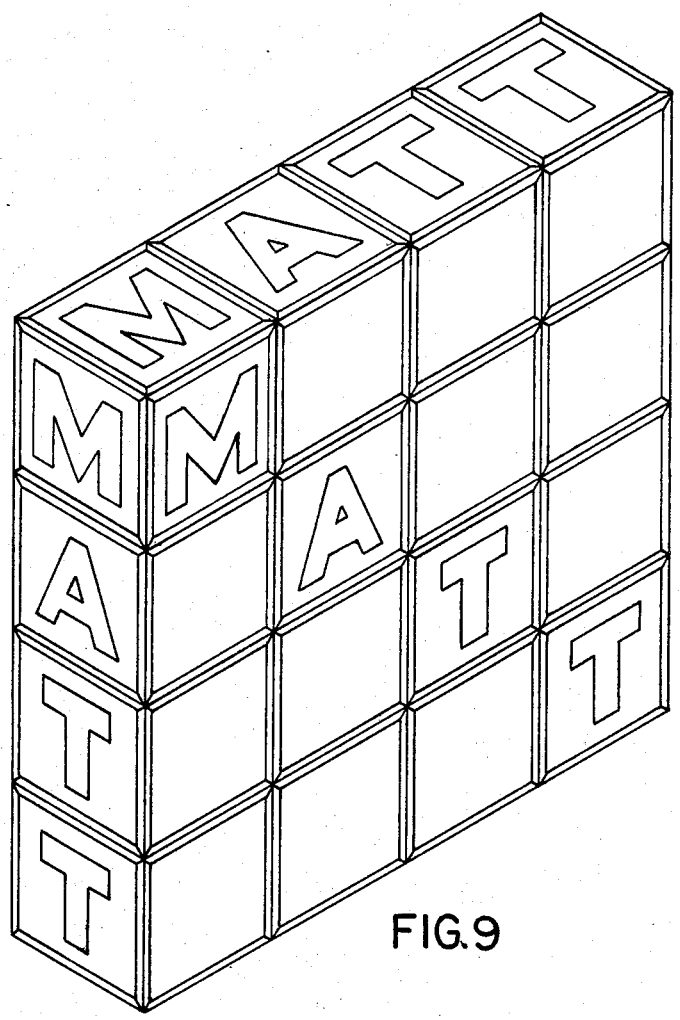
FIG. 9 is a perspective view of an alternative embodiment of the invention illustrating a sign composed of a 4×4×1 matrix array.

Referring now to FIG. 9, a matrix display is disclosed which is a four row, four column, one deep unit which would be attractive for specific applications wherein space is limited. However, the same unique features using the discrete modular concepts involved can create unique visual displays.

The matrix display of FIG. 9 can be made so as to be relatively thin in width compared to the surface dimensions. Thus, the matrix display of FIG. 9 can be utilized as a decorative wall, and assembled in abutting relationships so as to form enclosed structures or patterns, for example as a "V", a "T" or an "X" as desired.

In still other specific embodiments, two or more discrete sets of light sources are utilized in each module, enabling a variety of unique displays to be created depending upon which set of light sources is energized at any given time, and/or the sequence of illumination of the light sources. This can be accomplished by any number of programmable prior art devices. In the modular displays shown in FIGS. 7 and 9 each module can readily be interfaced with a programmable device which would control the power to each light source of each module and by selectively switching on the multiple light sources of each module any number of multicolored displays can be created.

As disclosed above, the improved apparatus and method of the invention for producing a multisided, multicolored display has been provided. This display is easily adaptable to any geometric dimension desired and is composed of discrete modular units arranged in a matrix form which presents a unique visual display. The display presents eye-catching, unique artistic renditions which are easily modified, altered or rearranged as desired. The hue, saturation and brightness of the light sources within the display are easily altered, and the display easily adaptable to provide animated symbols, objects in motions and three dimensional effects.

While there has been described above the principles of this invention in connection with a specific apparatus, it is to be clearly understood that this description is made only by way of example and not as a limitation to the scope of the invention.

What is claimed is:

1. An apparatus for producing a multisided display, comprising:

a plurality of modules, said modules being positioned in a matrix structure; each said module being an enclosure having at least one exposed light scattering sides;

means for illuminating said sides, including a plurality of common sources of different colored light;

a plurality of symbols;

means for positioning said symbols between said illuminating means and said light scattering sides; said modules being positioned in a matrix structure.

2. The apparatus of claim 1 wherein said illuminating means includes a plurality of light sources positioned in a spaced apart relationship with said sides, said light sources illuminating said sides, each said light source being of a different color, the radiation from each said light source overlapping adjacent said sides.

3. The apparatus of claim 1 further comprising means for individually altering the color of said light source.

4. The apparatus of claim 1 further comprising means for individually varying the intensity of said light sources.

5. The apparatus of claim 1 wherein one or more of said sides have an inwardly facing reflective surface.

6. The apparatus of claim 1 further comprises means for moving said symbols, whereby moving colored images are created.

7. A method of creating a multisided, multicolored display, comprising the steps of illuminating a plurality of light sources in an enclosure having a plurality of light scattering sides, each said light sources being of a different color, each said light scattering sides being illuminated by a mixture of light from said light sources, interposing one or more symbols between said light sources and said enclosure sides, whereby multicolored images are created on said sides.

* * * * *